United States Patent [19]

Rudenauer et al.

[11] Patent Number: 4,762,066

[45] Date of Patent: Aug. 9, 1988

[54] FUZE FOR A PARACHUTE-STABILIZED OR BAND-STABILIZED SMALL BOMB WHICH ROTATES DURING FLIGHT

[75] Inventors: Werner Rudenauer, Roth; Fritz Muller, Nuremberg; Dieter Kufner, Eckental-Eckenhaid; Joachim Furtmayr, Erlangen, all of Fed. Rep. of Germany

[73] Assignee: Diehl GmbH & Co., Nuremberg, Fed. Rep. of Germany

[21] Appl. No.: 70,367

[22] Filed: Jul. 7, 1987

[30] Foreign Application Priority Data

Jul. 22, 1986 [DE] Fed. Rep. of Germany ..... 3624713

[51] Int. Cl.[4] ..... F42B 13/50; F42C 15/04; F42C 15/22

[52] U.S. Cl. ..... 102/226; 102/269; 102/393; 102/489

[58] Field of Search ..... 102/225, 226, 227, 223, 102/229, 230, 244, 245, 266, 269, 393, 489

[56] References Cited

U.S. PATENT DOCUMENTS

| | | | |
|---|---|---|---|
| 1,751,616 | 3/1930 | Brayton | 102/226 |
| 2,838,999 | 6/1958 | Corsi | 102/269 X |
| 3,119,336 | 1/1964 | Hjelm | 102/269 X |
| 3,630,152 | 12/1971 | Arnell | 102/269 X |
| 3,926,122 | 12/1975 | Wolterman | 102/226 |
| 3,998,164 | 12/1976 | Hadfield | 102/226 |
| 4,455,940 | 6/1984 | Furuike | 102/230 X |
| 4,653,401 | 3/1987 | Gatti | 102/226 |

*Primary Examiner*—David H. Brown

*Attorney, Agent, or Firm*—Scully, Scott, Murphy & Presser

[57] ABSTRACT

A fuze for a parachute-stabilized or band-stabilized small bomb which rotates during flight, including a detonator arranged in a transversely movable slider; a detonator pin for blocking the slider in a secured position thereof through engagement into a bore, and wherein the detonator pin can be turned out of the bore by the rotating parachute or band through the intermediary of a screw-coupling in a housing. A pyrotechnic charge or composition is arranged within the slider and which serves as a timing element, which charge is ignited by a destructor pin supported in the slider, whereby the pyrotechnic charge will trigger the detonator at its exit side, and in the secured position, the detonator pin will block the resiliently pretensioned destructor pin.

6 Claims, 3 Drawing Sheets

FUZE FOR A PARACHUTE-STABILIZED OR BAND-STABILIZED SMALL BOMB WHICH ROTATES DURING FLIGHT

BACKGROUND OF THE INVENTION

1. Field of the Invention

The present invention relates to a fuze for a parachute-stabilized or band-stabilized small bomb which rotates during flight, including a detonator arranged in a transversely movable slider; a detonator pin for blocking the slider in a secured position thereof through engagement into a bore, and wherein the detonator pin can be turned out of the bore by the rotating parachute or band through the intermediary of a screw-coupling in a housing.

2. Discussion of the Prior Art

From the disclosure of German Laid-Open Patent Appln. No. 33 33 667 there has become known a fuze and safety device for ejectable ammunition, wherein a slider which is subjected to spring tension is releasable through the action of a detonator pin which is movable within a screw thread. A stabilizing band which is connected with the detonator pin brakes the detonator pin relative to the rotating ejectable ammunition, such that the tip of the detonator pin lifts away from the slider. A self-destruct device is not provided in this fuze and safety device. As a consequence thereof, this presents the disadvantage that ejectable ammunition which strikes against extremely soft ground will not be imparted any impact impulse or momentum which is relevant to a detonation. As a result, the detonator remains intact, so as to cause dangerous unexploded projectiles or so-called "duds" to remain strewn about the terrain.

SUMMARY OF THE INVENTION

Accordingly, it is an object of the present invention to provide a fuze for small bombs which affords that the detonator will in every instance be triggered even in the absence of an impact impulse or momentum which is relevant to a detonation. Hereby, the fuze should be constructed so as to be simple and highly-sensitive.

The foregoing object is achieved through the inventive features of a fuze as described hereinabove, in which a pyrotechnic charge or composition is arranged within the slider and which serves as a timing element, which charge is ignited by a destructor pin supported in the slider, whereby the pyrotechnic charge will trigger the detonator at its exit side, and in the secured position, the detonator pin will block the resiliently pretensioned destructor pin.

In accordance with a specific feature of the invention, the pyrotechnic charge in the slider, which charge serves as a timing element, together with the detonator and a destructor pin which is prestressed by a spring force, are arranged in a space-saving relationship. This spring is the only energy-storing element in the fuze. The spring merely supports the centrifugal forces which are caused by rotation, and which also act on the destructor pin for the activation of the pyrotechnic charge. The detonator pin fulfills a dual function, in effect, it secures the slider in a secured position, as well as securing the destructor pin in a secured position. This signifies that the self-destruct activation is coupled only to the detonator pin, so that already at a turned out detonator pin will there be ignited the pyrotechnic charge. The time-delayed triggering of the fuze which is caused by the charge extends over a time span which is substantially lengthier then the normal flying time required for the attacking of a target.

An inexpensive construction for the operable slider is attained when the destructor pin is supported the slider in the direction of movement of the slider within a bore possessing the same axis as the pyrotechnic charge.

Pursuant to a further feature of the invention, the necessary bores for the pyrotechnic charge in the slider are obtained within a small space, without creating the danger of an undesirable redundant ignition from the charge which is already burning down in the first bore to the charge which is located in the second bore.

Also obtainable is a simple construction which is constituted of a few and already available parts for the fixing of the destructor pin, in that in the secured position, the detonator pin contacts against the front end surface of the destructor pin.

Dangerous unexploded projectiles or duds, which has been already encountered with known fuzes for small bombs are avoided pursuant to the invention. The inventive detonator pin is dually supported through the guided length along a housing and through the collar of a box-like sheet metal guide, so as to ensure a centralized triggering of the detonator.

It is impossible to encounter any laterally deviating detonator pin with respect to the centralized triggering of the detonator.

In accordance with another feature of the invention, in an inexpensive manner there is achieved the damming of the triggered detonator, inasmuch as the detonator pin is provided with a conical opening which seals off the collar of the box-like sheet metal guide. This assists in the assured ignition of the transmission charge facing towards the explosive.

Pursuant to a further feature of the invention, it is adequate to provide for a single sideways engagement of a securing or safety slider which is supported on the housing against the slider which possesses the detonator. Consequently, upon error in assembly, for instance, during which there is forgotten the insertion of the detonator pin, within a formation of a plurality of superimposed or tiered small bombs, there cannot occur any undersired triggering of the detonator through the self-destruct arrangement. This danger is, in effect, present in the fuze arrangement pursuant to the current state-of-the-art, in which the slider is moved into the arranged position by means of a spring. Sideways impacts against the formation of small bombs, in effect, cause the outward emergence of the centrifugal safeties. The resultingly unsecured slider will then travel into the armed position in which a present self-destruct arrangement is triggered.

Pursuant to the invention, a spring force is not exerted against the slider. Thereby, the slider, even in the absence of the detonator pin, will remain in the secured position. At an eventually outwardly displaced safety slider, the latter will again move at an attenuated impact impulse or momentum into the securing bore, and again fixedly position the slider in a close-fitted manner.

In accordance with another aspect of the invention, it is possible to achieve an additional securing of the slider in the secured position in a constructively simple manner. The attained form-fit of the slider in the formation of the small bombs is achieved through constructively simple means.

In accordance with another inventive feature, for the triggering of the detonator at impact, it is sufficient to have a relatively low impact momentum. Inventively, there is present an extremely small friction radius along the bearing sleeve within the housing guide.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figures 1, 4:
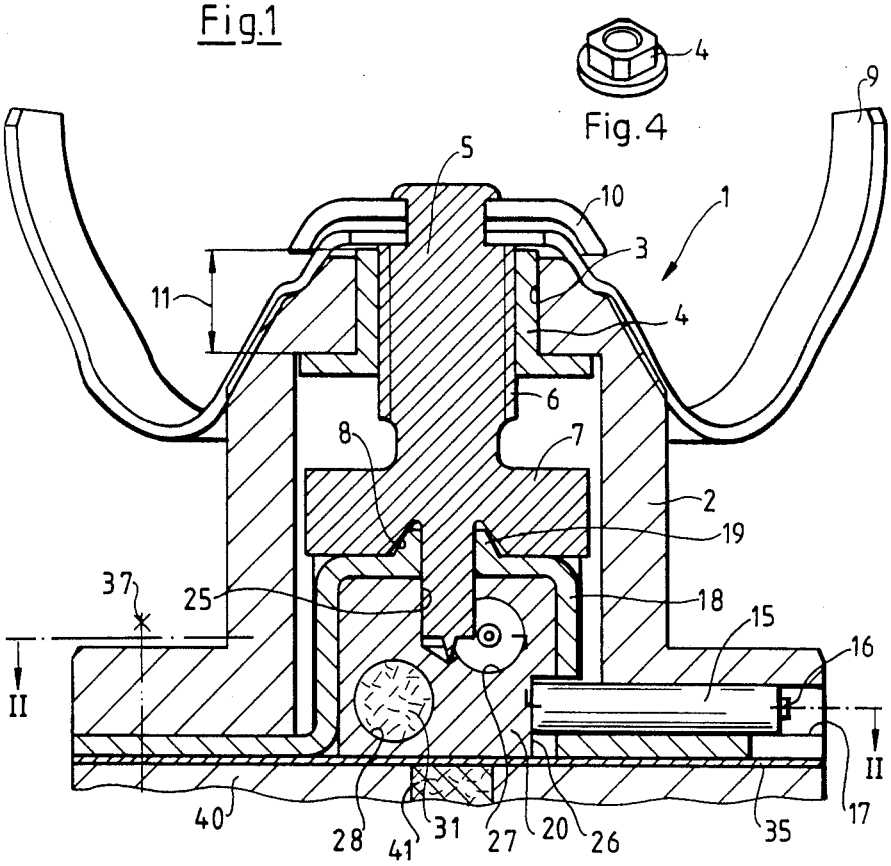
FIG. 1 illustrates a cross-sectional view through a fuze for a small bomb in the secured position thereof.
FIG. 4 illustrates a perspective view, on a reduced scale, of the detail of the bearing sleeve in FIG. 1.
Figure 2:
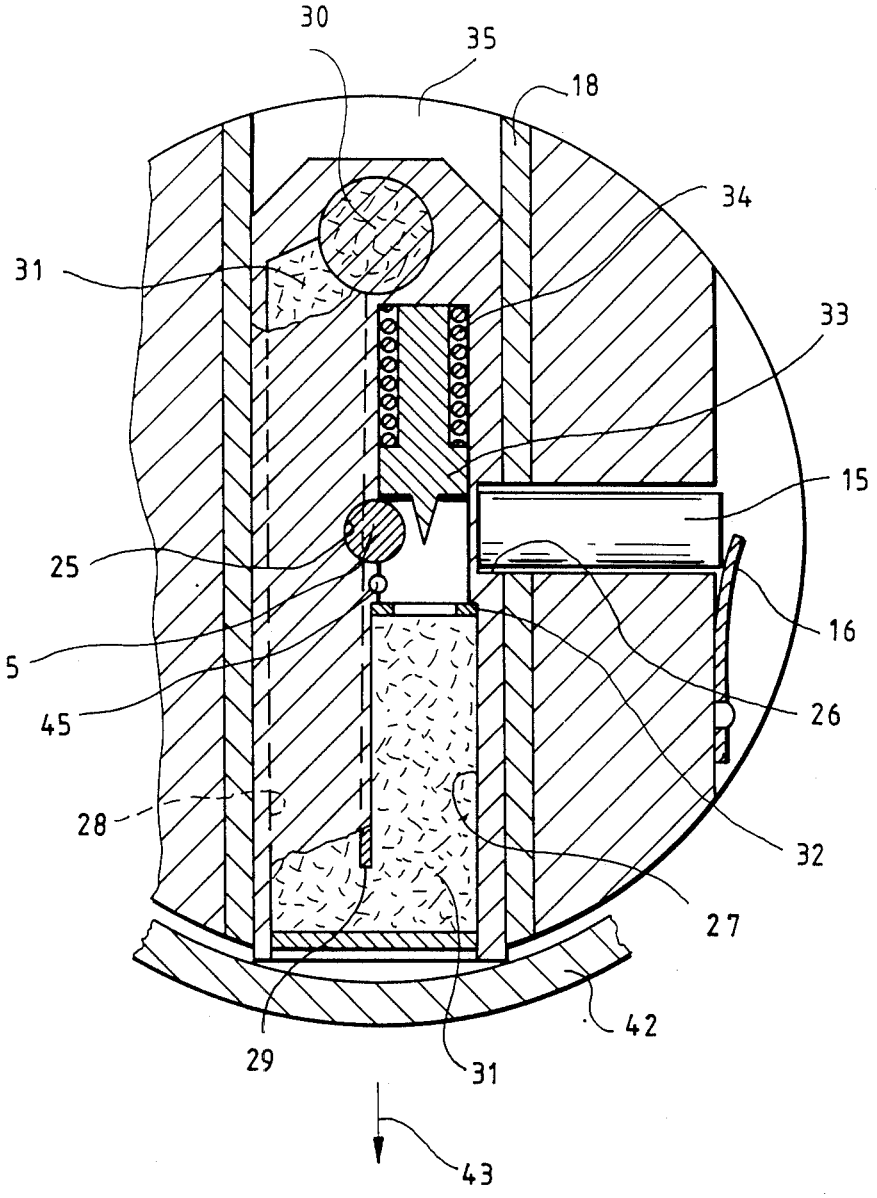
FIG. 2 illustrates a sectional view taken along line II—II.

A fuze 1 consists of a housing 2 with a guiding length or surface 11, a rectangular opening 3, a bearing sleeve 4 which is constructed as a square nut (as shown in FIG. 4), a detonator pin 5 with a screw thread 6, a ring 7, a conical recess 8, a stabilizing band 9 which is secured against rotation, a cap 10, a safety or securing slider 15, a bearing bore 17, a sheet metal guide 18 with a collar 19, a slider 20 possessing bores 25 through 29, a detonator 30, a generally U-shaped pyrotechnic charge or composition 31 which burns down in a time-delayed manner, a disc 32, a destructor pin 33, a spring 34, a sheet metal plate 35, a stop or contact 36 on the slider 20, and a positioning device (not shown) for the arming of the slider 20. As shown in FIGS. 1 and 2, a leaf spring 16 resiliently bears against the end of the securing slider 15, and exerts a pressure thereon so as to retain the slider 15 in position.

The housing 2 is connected through screw connections 37 with a casing 40 for explosives, which includes a transmitting charge 41.

Small bombs are assembled into a formation (not shown), for example, within a projectile. Contacting against the slider 20 as a safety is the casing 42 of a further mounted small bomb. The stop contact 36 is hereby located so as to contact against the wall 38 of the housing.

Figure 3:
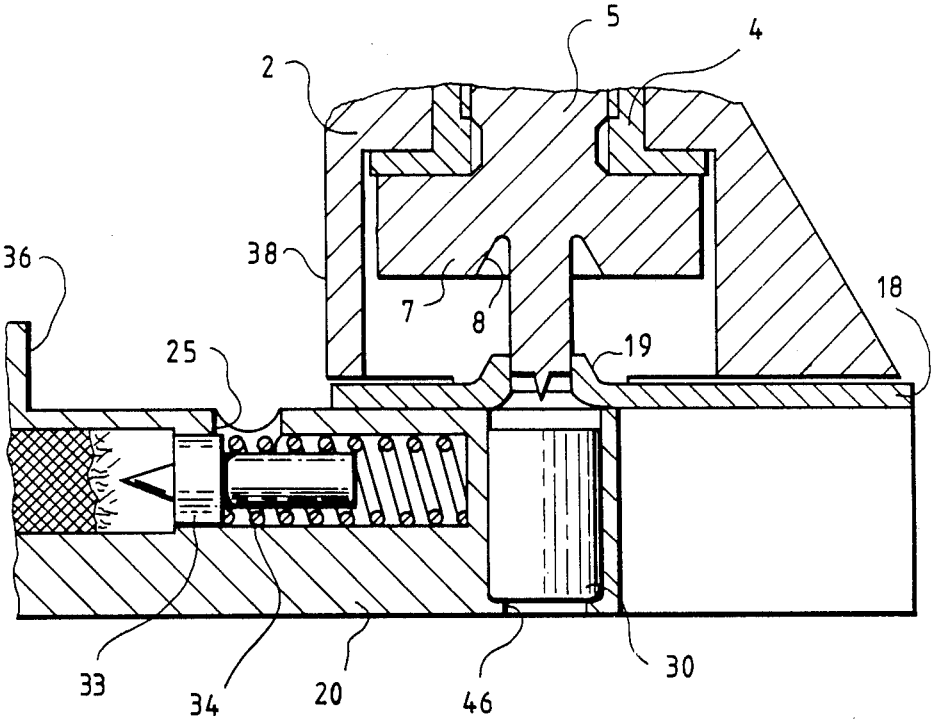
FIG. 3 illustrates the fuze of FIG. 1 in the armed position.

After the ejection of the small bombs from the projectile under a spin, the small bombs detach themselves from each other; in essence, the formation of the small bombs is loosened and the stabilizing band 9 unfolds itself. The casing 42 has freed the slider 20. The braking force of the stabilizing band 9 acts in opposition to the rotating small bomb, so that the detonator pin 5 is screwed out of the fuze housing 2 to such an extent until the ring 7 contacts against the bearing sleeve 4. Thereby, the detonator pin 5 unlatches the destructor pin 33, and the securing slider 15 releases the slider 20. The destructor pin 33 ignites the pyrotechnic charge 31, which burns down relatively slowly. The eccentrically located center of gravity 45 of the slider 20, because of the rotation of the small bomb, causes the slider 20 to be displaced in the direction of arrow 43 up to the arrested armed position (FIG. 3). In this position, the stop contact 36 on the slider 20 is moved away from the wall 38 on housing 2. The detonator pin 5 then stands above the detonator 30. When there is now encountered any impact of the small bomb which is relevant to detonation, the detonator pin 5 pierces the detonator 30, which will then ignite the transmission charge 41 through a passageway 46 so as to initiate the detonation of the small bomb.

When, in contrast therewith, there is not encountered any impact impulse or momentum of the small bomb which is relevant to triggering a detonation, then the detonator 30 is triggered by the pyrotechnic charge 31 which burns down until it reaches the detonator 30.

It is important to the invention that there are avoided dangerous unexploded projectiles or duds. Thus, even when the guidance for the slider in the housing 2 is damaged, there is still afforded that at the loosened formation connection of the small bombs, the detonator will be triggered, and in effect, independently of the position of the slider within the housing 2. The only prerequisite is, merely, that the detonator pin is turned out of the slider 20.

What is claimed is:

1. In a fuze for a small bomb which rotates during flight and which is parachute-stabilized or band-stabilized; a transversely displaceable slider; a detonator in said slider; a detonator pin engageable into a bore for blocking said slider in a secured position, said detonator pin being turnable out of said bore through a screw threaded connection in a housing responsive to the rotation of the parachute or band; and a destructor pin inserted in said slider under the resilient biasing of a spring for the triggering of said detonator, said destructor pin being blocked in a secured position by said detonator pin; the improvement comprising a pyrotechnic charge in said slider constituting a timing element, said pyrotechnic charge being arranged intermediate said destructor pin and the output end of said detonator, said destructor pin being movable in a coaxial bore relative to said pyrotechnic charge along the direction of movement of said slider; a securing slider supported in said housing laterally engaging said slider for securing said slider, said securing slider being displaceable in response to centrifugal force, and said detonator pin in the secured position concurrently contacting the leading end surface of the destructor pin.

2. Fuze as claimed in claim 1, wherein said pyrotechnic charge comprises two adjacently located and U-shape interconnected bores in said slider.

3. Fuze as claimed in claim 1, wherein said slider is supported in a box-like sheet metal guide having an outwardly projecting collar; and a conical recess in a ring on said detonator pin for receiving said projecting collar.

4. Fuze as claimed in claim 1, wherein a leaf spring is fastened to said housing for exerting a biasing compressive force to said securing slider.

5. Fuze as claimed in claim 1, wherein said slider includes a top contact for contacting a wall of said housing when, in the presence of superimposed bombs, a casing of a successive bomb contacts the slider.

6. Fuze as claimed in claim 1, comprising a bearing sleeve for supporting said detonator pin in said housing, said bearing sleeve being shaped as a square nut and being supported in said housing along a short guide surface for displacement in the direction of said slider.

* * * * *